US007251947B2

(12) United States Patent
Lifson et al.

(10) Patent No.: US 7,251,947 B2
(45) Date of Patent: Aug. 7, 2007

(54) REFRIGERANT SYSTEM WITH SUCTION LINE RESTRICTOR FOR CAPACITY CORRECTION

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 214 days.

(21) Appl. No.: 11/199,980

(22) Filed: Aug. 9, 2005

(65) Prior Publication Data

US 2007/0033965 A1 Feb. 15, 2007

(51) Int. Cl.
*F25B 1/00* (2006.01)

(52) U.S. Cl. ..... 62/115; 62/498

(58) Field of Classification Search ..... 62/83, 62/113, 115, 215, 199, 228.3, 511, 513, 498; 417/299

See application file for complete search history.

(56) References Cited

U.S. PATENT DOCUMENTS 2,133,875 A * 10/1938 Steenstrup ..... 417/312
2,198,258 A * 4/1940 Money ..... 62/296
3,108,453 A * 10/1963 Tinkey ..... 62/200
3,264,842 A * 8/1966 Dobbie ..... 62/217
3,312,080 A * 4/1967 Dahlgren ..... 62/155
3,442,439 A * 5/1969 Derragon, Jr. ..... 417/446
3,763,659 A 10/1973 Hover
4,549,857 A * 10/1985 Kropiwnicki et al. ..... 417/312
4,599,873 A 7/1986 Hyde
4,619,595 A * 10/1986 Amano et al. ..... 418/83
4,726,740 A * 2/1988 Suzuki et al. ..... 417/295
5,228,301 A * 7/1993 Sjoholm et al. ..... 62/84
5,410,889 A 5/1995 Sjoholm et al.
5,596,878 A * 1/1997 Hanson et al. ..... 62/160
5,768,901 A * 6/1998 Dormer et al. ..... 62/175
5,996,364 A * 12/1999 Lifson et al. ..... 62/196.1

FOREIGN PATENT DOCUMENTS

WO WO 94/20803 * 9/1994

OTHER PUBLICATIONS

International Search Report Dated Jan. 22, 2007.

* cited by examiner

*Primary Examiner*—Mohammad M. Ali
(74) *Attorney, Agent, or Firm*—Carlson, Gaskey & Olds, PC

(57) ABSTRACT

A fixed restriction is placed in a suction line leading to a compressor. The size of the restriction is selected to achieve a desired capacity reduction (correction) for the refrigerant system compressor. By selectively restricting the flow of refrigerant through the suction line, the capacity delivered by the compressor will be reduced. This allows a designer of a refrigerant system to utilize an available compressor of a specific size (displacement) to satisfy the desired system operating conditions and performance characteristics as well as application requirements. In embodiments, the refrigerant system may be provided with an economizer and unloader functions. The restriction may be placed in the compressor suction port, or in the suction line leading to the compressor. Further, a pair of parallel flow passages may communicate an evaporator to the compressor, with the restriction being placed in one and a solenoid valve placed in the other.

13 Claims, 2 Drawing Sheets

REFRIGERANT SYSTEM WITH SUCTION LINE RESTRICTOR FOR CAPACITY CORRECTION

BACKGROUND OF THE INVENTION

This application relates to the inclusion of a restriction in a line leading to a compressor in a refrigerant system to allow easy capacity correction for the refrigerant system.

Refrigerant systems are utilized in many air conditioning and heat pump applications for cooling and/or heating the air entering an environment. The cooling or heating load on the refrigerant system may vary with ambient conditions, and as the temperature and/or humidity levels demanded by an occupant of the environment change.

One goal in the design and application of refrigerant systems is a need to closely match a compressor displacement (its capacity) to the system requirements. As known, compressor models are available in stepped increments in size (displacement). Often, the required compressor displacement for a particular application falls "in-between" the available sizes, however. This can result in a system being oversized for a particular application, since the next available compressor of a larger size is typically selected. Having an oversized system is undesirable as it reduces system efficiency, since the heat exchangers now become undersized for the selected compressor, resulting in lower than desired saturation suction and higher than desired saturation discharge temperatures. Further, system reliability as well as temperature and humidity control may be compromised, since the system may cycle on/off more often than desired.

Additionally, lower than normal suction and higher than normal discharge pressures may cause nuisance system shutdowns if diagnostic controls see what would appear to be a problem.

One way refrigerant system designers have addressed these concerns is to provide an electronic suction modulation valve between the evaporator and the compressor. While this does allow modulation of the amount of refrigerant delivered by the compressor, a suction modulation valve presents a relatively large expense. Further, additional controls are required, and such valves are difficult to retrofit into existing refrigerant systems without further redesign. Also, as the refrigerant flow is reduced by an electronic expansion valve, the refrigerant superheat entering the compressor is typically increased as well. This results in higher discharge temperatures and may result in oil logging in the suction line, which is undesirable.

Therefore, there is a need for a simple and effective solution to reduce compressor displacement in order to match it to a particular system and to satisfy application requirements.

SUMMARY OF THE INVENTION

To address the above-discussed problems, in one embodiment, a restriction is placed in the suction line leading to the compressor. The size of the restriction may be varied and determined by the amount of reduction (correction) in system capacity desired for the given compressor size. The restriction can be placed in the suction line outside of the compressor, and can easily be retrofitted in the field. The restriction can also be integrated in the compressor suction port and installed during compressor or system assembly.

In another embodiment, a two-step modulation of capacity can be achieved by including an additional bypass loop into the suction line assembly. The restriction can be placed into this bypass loop, and a solenoid valve added to a main suction line. When full capacity is desired, the solenoid valve is opened, and suction vapor will flow through the main suction line as well as the bypass loop. When reduced capacity is desired, then the solenoid valve is closed, and all, although reduced, suction flow will be rerouted and delivered through the bypass loop.

The present invention can be utilized in combination with compressors having economizer and unloader options, and for any type of compressor commonly used in air conditioning, heat pump and refrigeration applications. As an example, scroll compressors, rotary compressors, reciprocating compressors, screw compressors, centrifugal compressors, etc. can all benefit from this invention.

These and other features of the present invention can be best understood from the following specification and drawings, the following of which is a brief description.

DETAILED DESCRIPTION OF THE PREFERRED EMBODIMENT

Figure 1:
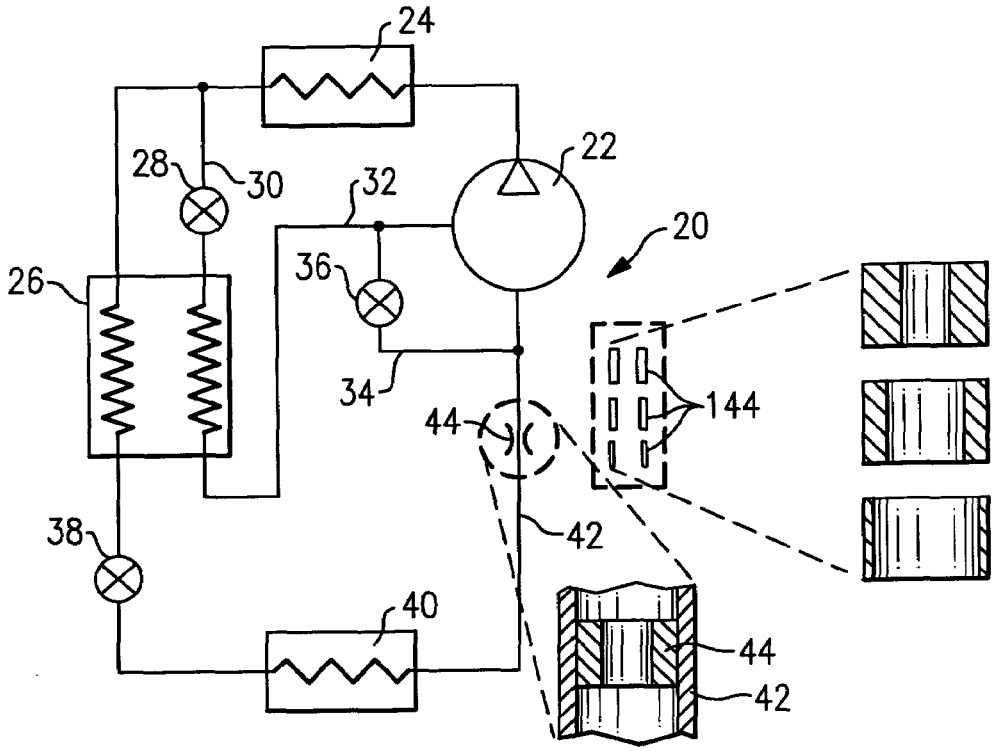
FIG. 1 shows a schematic refrigerant circuit incorporating the present invention.

A refrigerant system 20 is illustrated in FIG. 1. A compressor 22 compresses a refrigerant and delivers it downstream to a condenser 24. The refrigerant system 20 is shown incorporating an optional economizer circuit including an economizer heat exchanger 26. As known, a tap line 30 taps refrigerant from a liquid line of the main refrigerant circuit and passes it through an economizer expansion device 28, and then through the economizer heat exchanger 26. The economizer function is to subcool the refrigerant in the liquid line, and thus provide greater cooling potential to this refrigerant at the exit of the economizer heat exchanger 26. A tapped vapor refrigerant leaving the economizer heat exchanger 26 is returned through an economizer line 32 to an intermediate point of compression in the compressor 22. An optional unloader line 34 includes a valve 36 that is selectively opened to unload the compressor 22 when reduced capacity of the refrigerant system 20 is desired. While the tapped refrigerant and the refrigerant in the liquid line are shown flowing in the same direction through the economizer heat exchanger 26, in practice, it would be desirable to arrange the two flows in a counter-flow configuration. However, for simplicity of illustration, they are shown flowing in the same direction.

A main expansion device 38 is placed downstream of the economizer heat exchanger 26 and an evaporator 40 is located downstream of the main expansion device 38. Refrigerant in the main circuit is passed from the economizer heat exchanger 26 to the main expansion device 38, to the evaporator 40, and then to a suction line 42 from which it is returned to a suction port of the compressor 22. While the system shown in FIG. 1 has an economizer circuit, the invention would, of course, be applicable to systems without the economized circuit and/or unloader line.

As is known, the use of the economizer circuit, and the use of the unloader line allow a control for the refrigerant system 20 to achieve a wide variety of capacities. However, limitations in the incremental size (displacement) of the available compressors for the compressor 22 limit the desired degree of control over performance of the refrigerant system 20 that can be achieved to satisfy application requirements. Therefore, a restriction 44 can be placed in the suction line 42 to reduce the capacity of the compressor 22 to a desired level. The restriction 44 achieves such a capacity reduction by means of decreasing suction pressure (and consequently refrigerant density at the compressor suction port) and thus reducing refrigerant mass flow delivered by the compressor 22 and circulated through the refrigerant system 20. The size of the restriction can be selected from several available options 144 to obtain the desired capacity correction. The exact shape of the restriction typically is not important, as long as it provides a desired pressure drop as the refrigerant passes through the restriction. In practice, orifices of a different internal diameter can, for example, be selected to provide the required capacity adjustment. For illustration purposes the restrictions of various diameter are shown in 144. This technique can be applied, for instance, to retrofit existing refrigerant systems.

Figure 2:
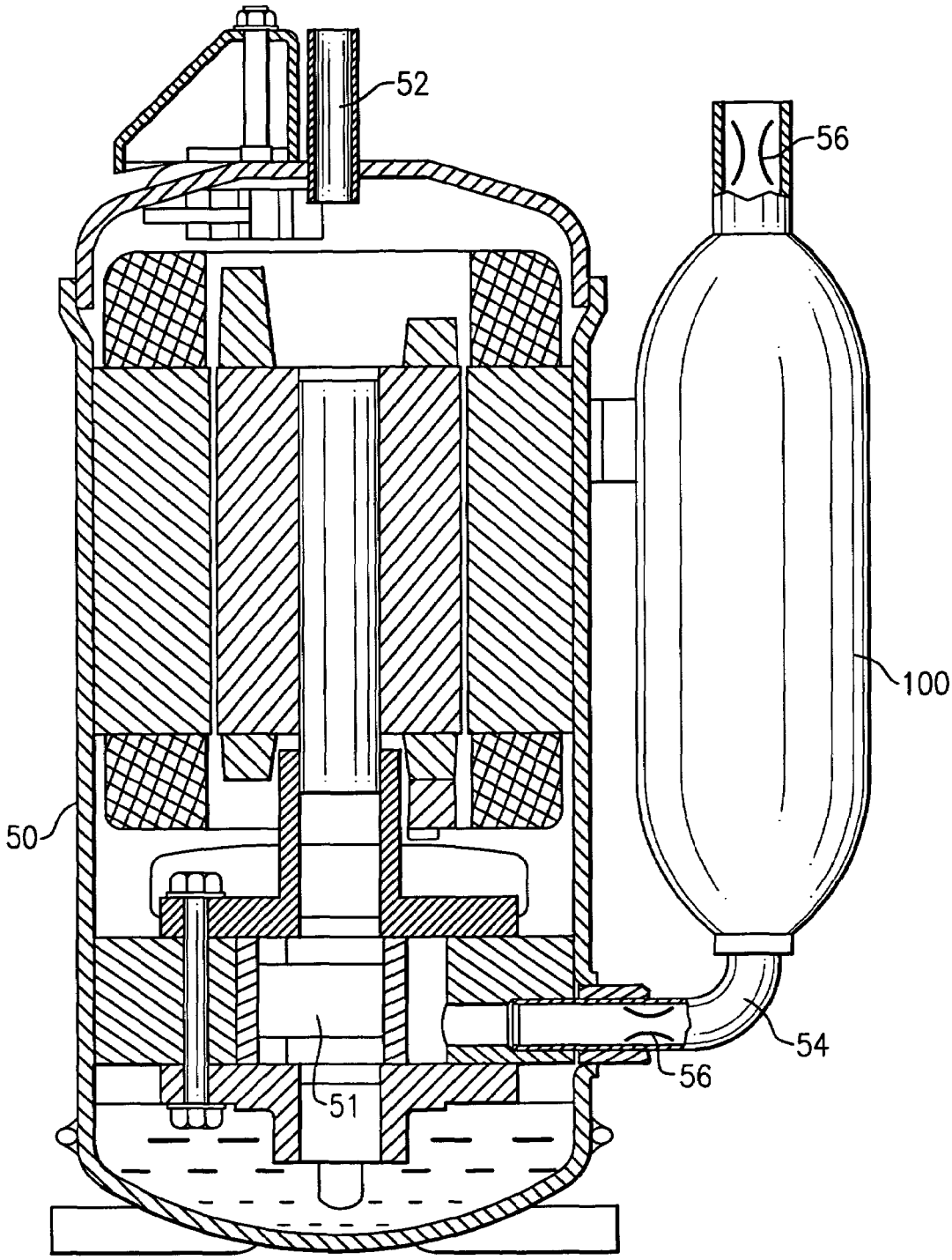
FIG. 2 shows another embodiment.

As illustrated in FIG. 2, a compressor 50 may have a discharge port 52 and a suction port 54. As also shown, the suction port 54 itself may incorporate the restriction 56. The FIG. 1 embodiment naturally lends itself to retrofitting in the field. However, as shown in FIG. 2, various locations for the restriction 56, such as an entrance to an accumulator 100, may be utilized that may be more practical to be applied at the assembly plant for the compressor 50 or refrigerant system 20.

As shown, a shell for the compressor 50 receives the discharge port 52 and the suction port 54. A compressor pump unit 51, which may be any known type, includes compression chambers that will compress refrigerant having moved into the compressor 50 through the suction port 54 from an upstream evaporator, and deliver this compressed refrigerant through the discharge port 52 to a downstream condenser.

Figure 3:
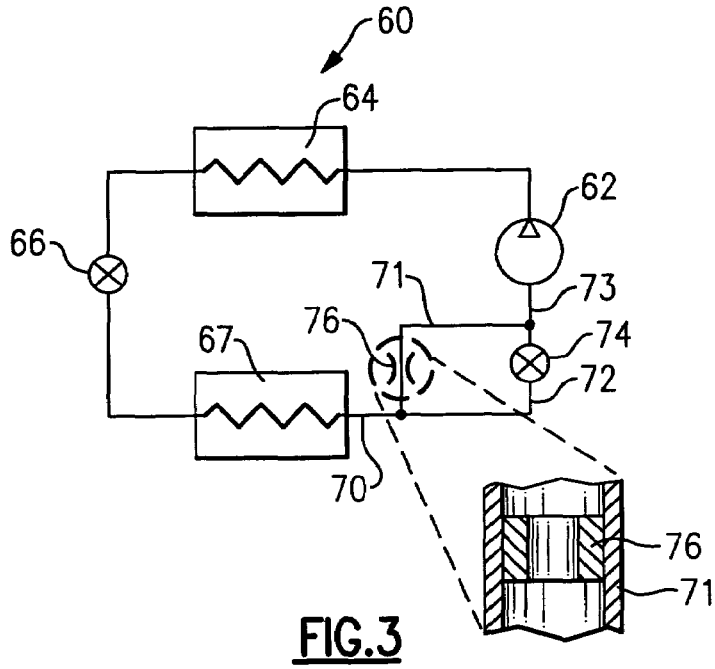
FIG. 3 shows yet another embodiment.

FIG. 3 shows yet another embodiment 60 wherein the compressor 62 delivers refrigerant to a condenser 64, then to a main expansion device 66, and then to an evaporator 67. As shown, a suction line 73 leading to the compressor 62 has two flow paths. A main line 72 passes through a solenoid valve 74. A bypass line 71 passes through a restriction 76, and then rejoins the main line 72 as it approaches the compressor 62.

A system control (not shown) is able to achieve two-step capacity modulation by either shutting or opening the valve 74. If reduced capacity is desired, the valve 74 is closed. Thus, lower amount of refrigerant will pass through the suction line 73. On the other hand, should full capacity be desired, the valve 74 is opened and refrigerant will pass through both lines 71 and 73.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a compressor compressing refrigerant and delivering the refrigerant through a discharge line to a condenser, an expansion device receiving refrigerant from said condenser, and an evaporator downstream of said expansion device, a suction line communicating said evaporator back to said compressor;

a fixed restriction downstream of said evaporator and upstream of the compression chambers in said compressor, the size of the restriction selected to achieve a desired capacity for the compressor; and wherein said suction line includes two branches, with at least one of said branches including a fixed restriction, and another of said branches including a selectively opened valve, said selectively opened valve being opened to provide additional capacity as desired, and closed when a reduced capacity is desired.

2. The refrigerant system as set forth in claim 1, wherein said fixed restriction is placed in a suction port of said compressor.

3. The refrigerant system as set forth in claim 1, wherein said fixed restriction is placed in a suction line leading to said compressor.

4. The refrigerant system as set forth in claim 1, wherein said fixed restriction is selected from a group of optional fixed restrictions sizes.

5. A refrigerant system comprising:

a compressor compressing refrigerant and delivering the refrigerant through a discharge line to a condenser, an expansion device recieving refrigerant from said condenser, and an evaporator downstream of said expansion device, a suction line communicating said evaporator back to said compressor;

a fixed restriction downstream of said evaporator and upstream of the compression chambers in said compressor, the size of the restriction selected to achieve a desired capacity for the compressor; and wherein an economizer heat exchanger is placed between said main expansion device and said condenser, and a tapped flow of refrigerant passes through said economizer heat exchanger, and said tapped flow of refrigerant being returned to said compressor to allow selective control of the performance of the refrigerant system.

6. A refrigerant system comprising:

a compressor compressing refrigerant and delivering the refrigerant through a discharge line to a condenser, an expansion device recieving refrigerant from said condenser, and an evaporator downstream of said expansion device, a suction line communicating said evaporator back to said compressor;

a fixed restriction downstream of said evaporator and upstream of the compression chambers in said compressor, the size of the restriction selected to achieve a desired capacity for the compressor; and wherein an unloader line selectively communicates intermediate compression chambers of said compressor back to said suction line, an unloader valve is placed in said unloader line, and said unloader valve is opened to reduce capacity provided by the refrigerant system.

7. A method of operating a refrigerant system comprising:

providing a compressor compressing refrigerant and delivering the refrigerant through a discharge line to a condenser, an expansion device receiving refrigerant from said condenser, and an evaporator downstream of said expansion device, a suction line communicating said evaporator back to said compressor;

providing a fixed restriction downstream of said evaporator and upstream of the compression chambers in said compressor, the size of the fixed restriction selected to achieve a desired capacity for the compressor; and wherein said suction line includes two branches, with at least one of said branches including a fixed restriction, and another of said branches including a selectively opened valve, said selectively opened valve being opened to provide additional capacity as desired, and closed when a reduced capacity is desired.

8. The method as set forth in claim 7, wherein said fixed restriction is placed in a suction port of said compressor.

9. The method as set forth in claim 7, wherein said fixed restriction is placed in a suction line leading to said compressor.

10. A method of operating a refrigerant system comprising:

providing a compressor compressing refrigerant and delivering the refrigerant through a discharge line to a condenser, an expansion device receiving refrigerant from said condenser, and an evaporator downstream of said expansion device, a suction line communicating said evaporator back to said compressor;

providing a fixed restriction downstream of said evaporator and upstream of the compression chambers in said compressor, the size of the fixed restriction selected to achieve a desired capacity for the compressor; and wherein said fixed restriction is placed in a suction line leading to said compressor.

11. The method as set forth in claim 7, wherein said fixed restriction is inserted into the refrigerant system as a retrofit.

12. A method of operating a refrigerant system comprising:

providing a compressor compressing refrigerant and delivering the refrigerant through a discharge line to a condenser, an expansion device receiving refrigerant from said condenser, and an evaporator downstream of said expansion device, a suction line communicating said evaporator back to said compressor;

providing a fixed restriction downstream of said evaporator and upstream of the compression chambers in said compressor, the size of the fixed restriction selected to achieve a desired capacity for the compressor; and wherein an economizer heat exchanger is placed between said main expansion device and said condenser, and a tapped flow of refrigerant passes through said economizer heat exchanger, and said tapped flow of refrigerant being returned to said compressor to allow selective control of the performance of the refrigerant system.

13. A method of operating a refrigerant system comprising:

providing a compressor compressing refrigerant and delivering the refrigerant through a discharge line to a condenser, an expansion device receiving refrigerant from said condenser, and an evaporator downstream of said expansion device, a suction line communicating said evaporator back to said compressor;

providing a fixed restriction downstream of said evaporator and upstream of the compression chambers in said compressor, the size of the fixed restriction selected to achieve a desired capacity for the compressor; and an unloader line selectively communicates intermediate compression chambers of said compressor back to said suction line, an unloader valve is placed in said unloader line, and said unloader valve is opened to reduce capacity provided by the refrigerant system.

* * * * *

UNITED STATES PATENT AND TRADEMARK OFFICE

CERTIFICATE OF CORRECTION

PATENT NO. : 7,251,947 B2
APPLICATION NO. : 11/199980
DATED : August 7, 2007
INVENTOR(S) : Lifson et al.

It is certified that error appears in the above-identified patent and that said Letters Patent is hereby corrected as shown below:

Claim 4, Column 4, line 17: "restrictions" should read as --restriction--

Claim 5, Column 4, line 21: "recieving" should read as --receiving--

Claim 6, Column 4, line 39: "recieving" should read as --receiving--

Column 5, lines 8-21;
Claim 10 should read as follows: --The method as set forth in claim 7, wherein said fixed restriction is placed in a suction line leading to said compressor.--

Claim 12, Column 6, line 10: "performance" should read as --capacity--

Column 6, lines 29;
Please add the following claim: --The method as set forth in claim 7, further including the step of selecting a desired fixed restriction size from a plurality of available sizes of fixed restrictions.--

Signed and Sealed this

Fourth Day of December, 2007

JON W. DUDAS
*Director of the United States Patent and Trademark Office*